US006322028B1

(12) United States Patent
Fleckenstein

(10) Patent No.: US 6,322,028 B1
(45) Date of Patent: Nov. 27, 2001

(54) CONTAINER SUPPORTING DEVICE

(76) Inventor: Mark A. Fleckenstein, 6769 N. FM 51, Decatur, TX (US) 76234

( * ) Notice: Subject to any disclaimer, the term of this patent is extended or adjusted under 35 U.S.C. 154(b) by 0 days.

(21) Appl. No.: 09/567,376

(22) Filed: May 10, 2000

(51) Int. Cl.[7] ..... E06C 7/14
(52) U.S. Cl. ..... 248/210; 182/129
(58) Field of Search ..... 248/210, 202.1, 248/282.1, 316.4, 213.2, 218.4, 229.13, 227.3, 228.4, 229.14, 228.3, 316.5, 316.6, 211; 182/129

(56) References Cited

U.S. PATENT DOCUMENTS

| | | | | |
|---|---|---|---|---|
| 1,221,658 | * | 4/1917 | Berry | 248/210 |
| 1,313,803 | * | 8/1919 | Dunn | 248/210 |
| 3,051,428 | | 8/1962 | Schult . | |
| 3,094,304 | * | 6/1963 | Linder, Jr. | 248/211 |
| 3,353,778 | * | 11/1967 | Sylvain et al. | 248/211 |
| 3,357,668 | * | 12/1967 | Carrell | 248/210 |
| 3,980,264 | * | 9/1976 | Tomasik | 248/210 |
| 3,987,993 | | 10/1976 | Hopkins . | |
| 4,025,016 | | 5/1977 | Brothers . | |
| 4,036,463 | * | 7/1977 | Hopkins et al. | 248/210 |
| 4,186,903 | * | 2/1980 | Fazakerley | 248/210 |
| 4,424,949 | * | 1/1984 | Kimmett et al. | 248/238 |
| 4,776,550 | | 10/1988 | Storey . | |
| 5,106,045 | | 4/1992 | Bezotte . | |
| 5,145,226 | * | 9/1992 | LaFontaine | 248/210 X |
| 5,305,977 | * | 4/1994 | Roth | 248/210 |
| 5,806,817 | | 9/1998 | Loud . | |
| 5,853,158 | | 12/1998 | Riggle . | |
| 5,855,346 | * | 1/1999 | Hall | 248/210 |
| 6,186,242 | * | 2/2001 | Bricko | 172/40 |

* cited by examiner

*Primary Examiner*—Ramon O. Ramirez
*Assistant Examiner*—A. Joseph Wujciak
(74) *Attorney, Agent, or Firm*—Lee, Mann, Smith, McWilliams, Sweeney and Ohlson

(57) ABSTRACT

An improved apparatus for adjustably attaching a container to a ladder side member. The apparatus includes a ladder clamp assembly, an offset support arm, and a container clamp assembly. The ladder clamp assembly allows releasable attachment with the side rail of a ladder. The ladder clamp assembly includes a first and second ladder clamp jaws that are positioned around the ladder side rail and clamped by tightening a fastener with an adjustment knob. The container clamp assembly allows releasable attachment with a container. The container clamp assembly includes a C-shaped member and an elongated support member. The members are positioned so the C-shaped member is around the lip of and in contact with the inside of the container and the elongated support member is in contact with the outside of the container. The members are clamped together by tightening a second fastener with a second adjustment knob. The ladder clamp assembly and the container clamp assembly are attached to the support arm by passing the fasteners through apertures in the ends of the support arm.

12 Claims, 2 Drawing Sheets

CONTAINER SUPPORTING DEVICE

BACKGROUND OF THE INVENTION

This invention is an improved container supporting device that allows attachment of a container to a ladder having improved features including ease of attachment to a ladder and further having the geometry enabling the container supporting device to continuously maintain the container in a level horizontal position with respect to the ground to prevent liquid from spilling out of the container.

DESCRIPTION OF RELATED ART

When painting in places elevated enough to warrant the use of a ladder, difficulties have arisen as to where the paint container can be placed for ease of access while standing on the ladder. The majority of ladders, especially extension ladders, do not provide a location to place a paint container while painting on a ladder which makes it inefficient and dangerous to paint. Furthermore as the painter moves up or down the ladder the location of the can needs to be changed. Without a paint container holder, the painter has two options. They can either step down off the ladder to reapply paint to their brush, which takes a considerable amount of time, or physically hold the paint can in one hand and paint with the other which is dangerous because the painter no longer has a free hand to grasp the ladder. A number of prior art devices have addressed this problem by providing a variety of paint container holders that can be movably attached to ladders.

While these prior art devices fulfill their respective, particular objectives, these devices do not provide a simple, inexpensive device which is movably attachable to a ladder and can automatically support the container in a level position regardless of the angle of the ladder. When the ladder is moved to a higher elevation or the base is moved to a different location, the paint container holder will automatically adjust the position of the container to prevent the paint or other liquid in the container from spilling. The mechanism by which the paint container holder is attached to a ladder is adaptable to fit most, if not all types and sizes of ladders commonly in use such as wood, aluminum or fiberglass by means of a simple adjustment.

Although numerous prior art paint container holders have been developed to solve certain of the aforementioned problems, none have adequately resolved all of the problems and provide an easy to use, cost effective self-leveling container holder.

SUMMARY OF THE INVENTION

The invention may be described as a self-leveling container supporting device adapted to be adjustably attached to a ladder for supporting a container. The device includes an offset support arm having a clamping mechanism on each end of the arm. One clamp can be attached to a ladder and the other clamp attaches to and supports a container, both clamps being pivotally attached to the offset support arm. The container clamp consists of several components including a C-shaped member, a fastener with an adjustment knob and an elongated support member. The C-shaped member fits around the lip at the opening of the paint can. The elongated support arm is positioned between the offset support arm and the C-shaped member and vertically contacts the outside surface of the paint container. When the C-shaped member is properly positioned over the lip of the paint container, the knob is tightened to clamp the member to the paint container.

The ladder clamp assembly consists of several components including a first ladder clamp jaw, a second ladder clamp jaw, a fastener and an adjustment knob. The first and second clamp member are positioned to engage a vertical side support of a ladder. When the first and second ladder clamp jaws are properly positioned around the ladder side support, the adjustment knob is tightened to compress the first and second ladder clamp jaws to create a firm grip on the ladder to provide solid attachment for supporting a paint container.

The pivot points located at each clamp end of the support arm allow rotational movement about an axis perpendicular to the other pivot point, thereby allowing the paint container to swivel about both axes. The primary function of the swivel device is to maintain the paint container in a level position with respect to the ladder position. When the ladder is adjusted or moved, the pivot points on the device will automatically adjust the position of the paint container so that it remains level with the ground and does not spill its contents. With this device, the paint container does not need to be removed from its position on the ladder when the ladder is moved to another location by the painter but can be adjusted up or down on the ladder as the painter moves up or down.

DETAILED DESCRIPTION OF THE PREFERRED EMBODIMENT

While the present invention will be described fully hereinafter with reference to the accompanying drawings, in which a particular embodiment is shown, it is understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1:
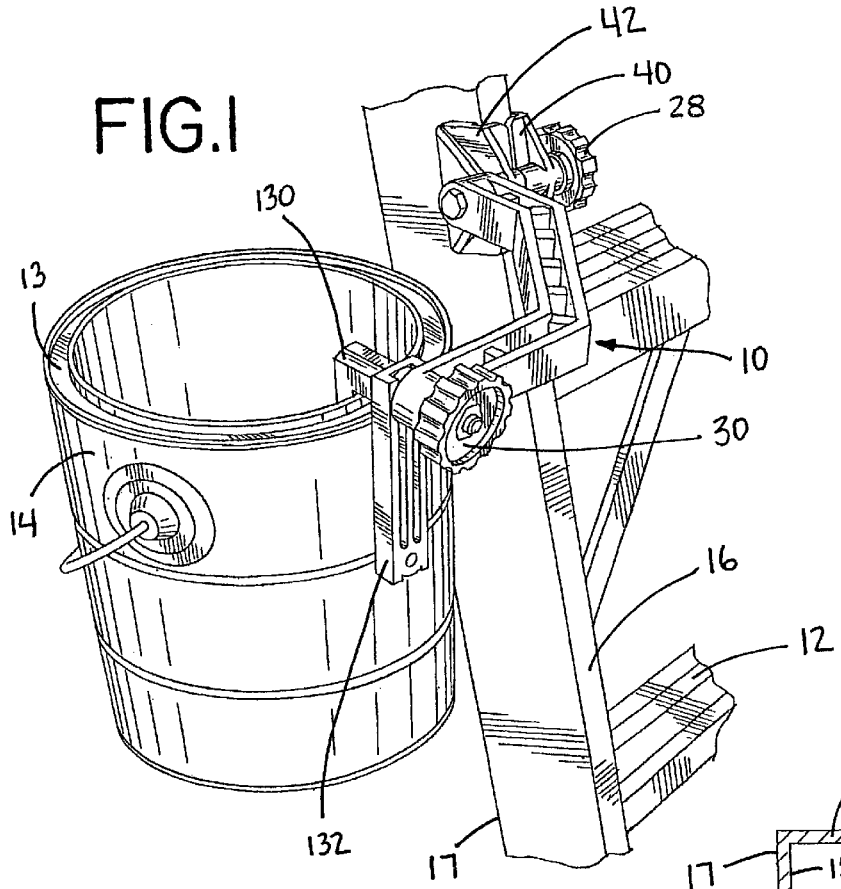
FIG. 1 is a perspective view of the container supporting device attached to a container and a ladder.

A preferred embodiment of the container supporting device 10 of the present invention is shown in FIG. 1 attached at one end to a ladder 12 and at the other end to a container 14 for holding paint or other liquid. The container supporting device 10 is adapted to removably mount the container 14 to the ladder 12. The device 10 is also adapted to releasably attach to a variety of ladders including free standing, extension and the like constructed out of materials such as metal, wood and fiberglass, the ladders having either a solid or channel configuration.

The container supporting device 10 releasably attaches to a side rail 16 of the ladder 12. The container 14, which may contain paint or other liquid, releasably attaches to the container supporting device 10 and has a configuration that uses the container weight to automatically level the container 14 with respect to the ground to prevent the contents from spilling.

Figure 3:
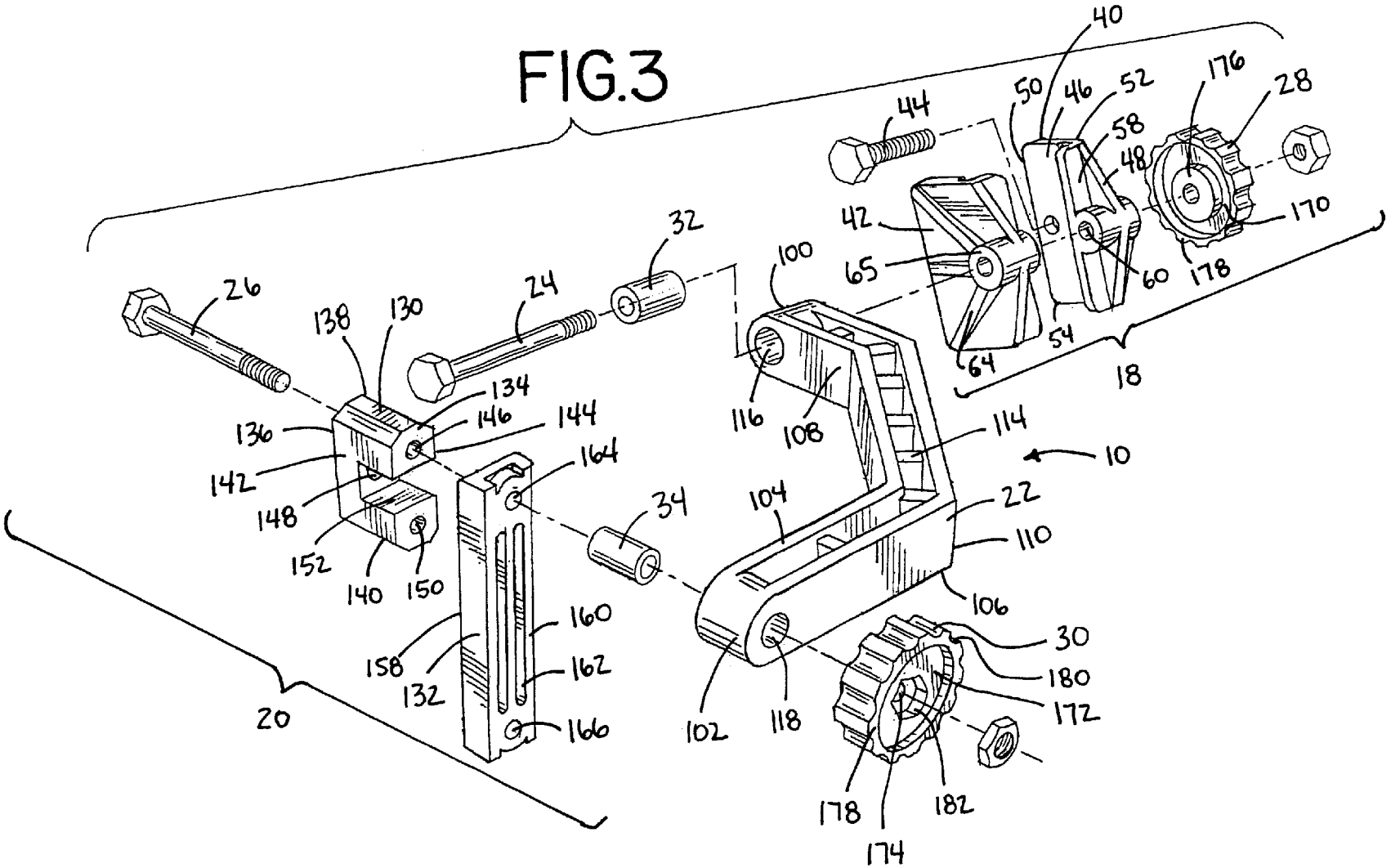
FIG. 3 is an exploded view of the container supporting device illustrated in FIG. 1.

The device 10, as best shown in FIG. 3, includes a ladder clamp assembly 18, a container clamp assembly 20, a support arm 22, a pair of fasteners 24 and 26 with adjustment knobs 28 and 30 and a pair of bushings 32 and 34. The ladder clamp assembly 18 includes a first ladder clamp jaw 40, a second ladder clamp jaw 42 and an adjustable bolt 44 on the first jaw 40.

Figure 2:
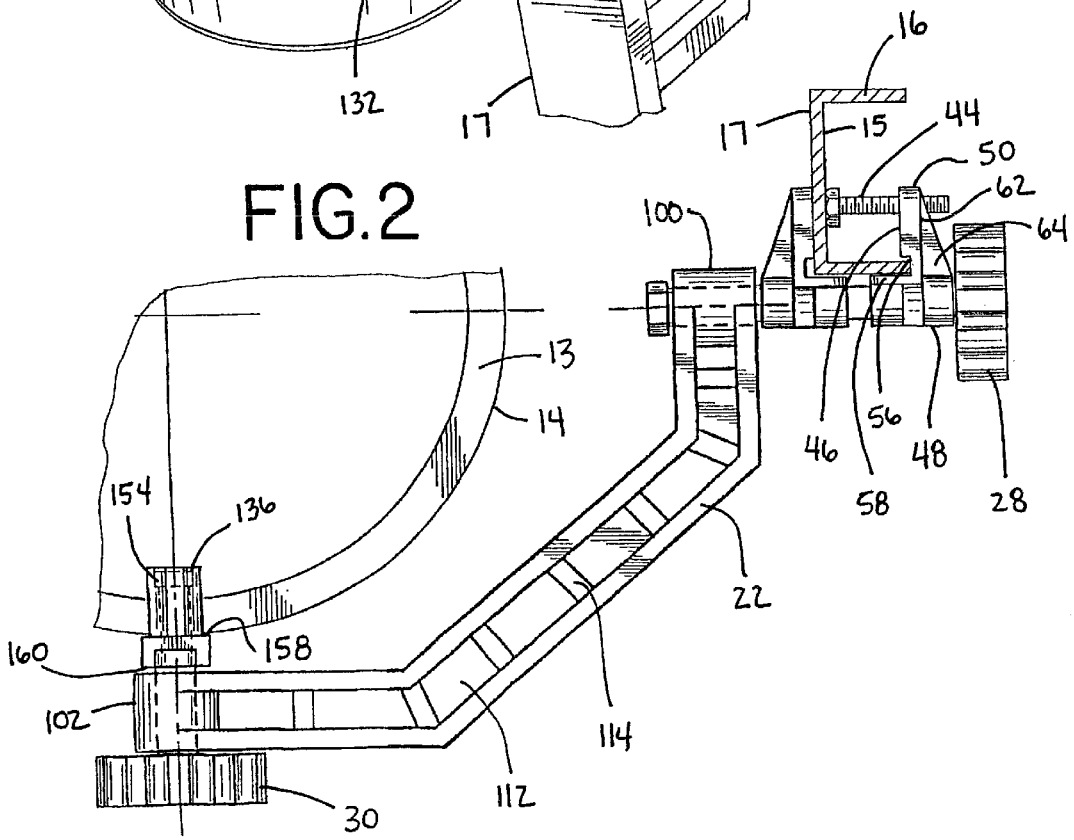
FIG. 2 is a top plan view of the container supporting device illustrated in FIG. 1.

The ladder clamp jaws 40 and 42 are identical in configuration with the exception of the addition of adjustment bolt 44 which is attached to the first ladder clamp jaw 40. The ladder clamp jaws 40 and 42, are preferably L-shaped and include a front surface 46 having a top edge 48, a spaced apart bottom edge 50, a first side edge 52 and a spaced apart second side edge 54. The front surface 46 is preferably substantially planar such that the bottom edge 50, first side edge 52 and second side edge 54 are substantially rectilinear. The top edge 48 includes a cylinder shape transversely and centrally situated to the planar front surface 46. The front surface 46 further includes an outwardly extending flange 58, as shown in FIG. 2, located near the top edge 48 and a groove 56 that extends along the length of the face adjacent to the flange 58. The groove 56 is positioned to accept and engage the channel edge of a ladder side rail 16 that has a channel instead of a solid configuration. An aperture 60, as shown in FIG. 3, is located near the top edge 48 and centered between the first side edge 52 and the second side edge 54. The aperture 60 has a diameter slightly larger than the first fastener 24 to allow the first fastener 24 to pass therethrough. The front surface 46 of the first clamp jaw 40 further includes an adjustable fastener such as bolt 44, as shown in FIG. 2, which can be adjusted to engage the inside surface 15 of the ladder side rail 16 of a channeled ladder but can be removed for use with a solid ladder. The front surface 46 has a smooth finish but may incorporate a textured finish to provide additional friction when attached to the ladder side rail 16. The ladder clamp jaws 40 and 42 also include a rear surface 62 sharing the same top edge 48, bottom edge 50, first side edge 52, as shown in FIG. 3, and second side edge 54 with the front surface 46. The rear surface 62, shown in FIG. 2, is substantially planar with the exception of a plurality of ribs 64 and a boss 65 thru which the aperture 60 extends. The boss 65 protrudes from the rear surface 62 near the top edge 48, equally spaced from the first side edge 52 and the second side edge 54. The plurality of ribs 64 extend outwardly from the side of aperture 60 and gradually taper as they extend to and are equally spaced along the bottom edge 50. The rear surface 62 at the opening of the aperture 60 is adapted to allow the inner surface 66 of the first adjustment knob 28 to directly contact and apply a lateral force to allow for clamping of the ladder side rail 16.

The support arm 22, shown in FIGS. 2 and 3, includes a ladder clamp end 100 and a container clamp end 102. The support arm 22 further includes a top surface 104, a spaced apart bottom surface (not shown), an inside surface 108 and a spaced apart outside surface 110. The support arm 22 incorporates two bends of approximately 45 degrees so the ladder clamp end 100 is perpendicular to the container clamp end 102. The top surface 104 includes a recess 112 and a plurality of ribs 114 that are spaced apart across the length of the support arm 22. The bottom surface is a mirror image of the top surface and also includes a recess and a plurality of ribs that are spaced apart across the length of the support arm 22. The purpose of the ribs is to provide added strength to the structure. The ends of the support arm 22, best shown in FIG. 3, include a first aperture 116 located at the ladder clamp end 100 and a second aperture 118 located at the container clamp end 102. Apertures 116 and 118 are visible from either the inside 108 or outside 110 surface and are large enough in diameter to loosely accept bushings 32 and 34. Bushings 32 and 34, which can be made out of a variety of metals and plastics, have an axial length longer than the distance between the inner surface 108 and the outer surface 110 to allow the ladder clamp assembly 18 and the tray clamp assembly 20 to freely pivot when the first 24 and second 26 fasteners are tightened. The ladder clamp end 100 and the container clamp end 102 are curved at a radius larger than the radius of apertures 116 and 118. The ladder clamp assembly 18 and the container clamp assembly 20 are pivotally attached to the support arm 22 with fasteners 24 and 26 respectively.

The container clamp assembly 20, best shown in FIG. 3, includes a container clamp jaw illustrated as a C-shaped member 130 and an elongated support member 132. The C-shaped member 130 includes a front surface 134 a spaced apart rear surface 136, a top edge 138, a spaced apart bottom edge 140, a first side edge 142 and a spaced apart second side edge 144. The C-shaped member 130 further includes a horizontally extending notch 152 that extends halfway through the member 130 to create a recess to engage the lip 13 of the container 14. The front surface 134 includes a first aperture 146, a second aperture 148 and a third aperture 150 that pass longitudinally through the C-shaped member 130 and exit on the rear surface 136. The lower portion of the first surface 134 is adapted to engage the inner surface of the container 14. The middle portion of the first surface 134 which contains the notch 152 is adapted to engage the lip 12 of the container 14. The top portion of the front surface 134 is adapted to engage the elongated support member 132. The rear surface 136, shown in FIG. 2, is substantially planar and includes two hexagonal recesses 154 to receive the head of the second fastener 26 to prevent its rotation.

The elongated support member 132, shown in FIG. 2, includes an inner face 158 and a spaced apart outer face 160. The inner face 158 is substantially planar and is adapted to engage the outside surface of the container 14. The inner face 158 includes a smooth finish but may incorporate a textured surface if necessary. The outer face 160 includes vertically extending grooves 162 to increase the stiffness of the elongated support member 132. The elongated support member 132, as shown in FIG. 3, further includes a pair of apertures 164 and 166 with a diameter large enough to allow the passage of the second fastener 26. When second fastener 26 is inserted through the first aperture 146 of the C-shaped member 130, aperture 164 of the elongated support member 132 and the bushing 32 of the second aperture 118 of the support arm, the container clamp assembly 20 can be drawn together to allow for attachment to a container 14.

The adjustment knobs 28 and 30 are identical in configuration. The knob 28 is shown in FIG. 3 and includes an inner surface 170 and a spaced apart outer surface 172 and is generally circular in shape. The adjustment knob 28 further includes aperture 174 that is centrally positioned. The inner surface 170 includes a central circular portion 176 and an outer circumference 178 near the edge, that extend outwardly from the inner surface 170 of the knobs 28 and 30. The central circular portion 176, as shown in FIG. 2, is adapted to engage the rear surface 62 of the first ladder clamp jaw 40. The outer surface 172, shown in FIG. 3, which is also circular, includes a hexagonal recess 182 centrally located which is designed to accept a standard threaded nut. The outer circumference 178 includes a plurality of evenly spaced semicircular recesses 180 that allow the knobs 28 and 30 to be tightened with less effort.

To attach the container supporting device 10 to the ladder side rail 16, the first fastener 24 is loosened by turning the first adjustment knob 28 counterclockwise so that the first ladder clamp jaw 40 can be separated from the second ladder clamp jaw 42. Since the apertures 60 and 84 have a diameter larger than the first fastener 24, an operator can easily separate the jaws 40 and 42 by simply grabbing and sliding them in a direction opposite one another. The container supporting device 10 is then positioned so the front surface 46 of the first ladder clamp jaw 40 comes into contact with the inside surface 15 of the ladder side rail 16 and the front surface 70 of the second ladder clamp jaw 42 comes into contact with the outside surface 17 of the ladder side rail 16. When the first clamp jaw 40 and the second clamp jaw 42 are properly positioned on the ladder side rail 16, the first fastener 24 is tightened by turning the first adjustment knob 28 clockwise to compress the front surfaces 46 and 70 against the inside 15 and outside 17 surfaces of the ladder side rail 16.

To attach a container 14 to the container supporting device 10, second fastener 26 is loosened by turning the second adjustment knob 30 counterclockwise so the C-shaped member 130 can be separated from the elongated support member 132. Since the apertures 146 and 164 have a diameter larger than the second fastener 26, an operator can easily separate the C-shaped member 130 and the elongated support member 132 by simply sliding them in a direction opposite one another. The C-shaped member 130 is placed around the container lip 13 so the lip 13 is resting in the notch 152. The elongated support member 132 is placed adjacent to and in vertical contact with the outside surface of the container 14. When the C-shaped member 130 and the elongated support member 132 are in the correct position, the second fastener 26 is tightened by turning the second adjustment knob 30 clockwise to compress the front surfaces 134 and the inner face 158 against the inside 15 and outside 17 surfaces of the container 14. When the container supporting device 10 is attached to the ladder side rail 16 and the container 14, the weight of the container 14 pulls downward on the container clamp assembly 20 which freely pivots about the second aperture 118. The downward force is transferred through the support arm 22 to the first aperture 116 which is perpendicularly offset from the second aperture 118. The transferred force creates a moment force along the axis of the first aperture which in turn transfers the moment force to the ladder clamp assembly 18. The container supporting device 10 automatically allows the container 14 to remain level even after the ladder 12 has been repositioned.

Various features of the invention have been particularly shown and described in connection with the illustrated embodiment of the invention, however, it must be understood that these particular arrangements merely illustrate, and that the invention is to be given its fullest interpretation within the terms of the appended claims.

I claim:

1. A self-leveling supporting device to secure a container to a ladder including:

a support arm having a first end defining a first central axis of rotation about which said support arm may pivot, said first end adapted to be secured to a ladder and a second end defining a second central axis of rotation about which said support arm may pivot, said second end adapted to be secured to a container, said first axis lying perpendicular to said second axis;

a ladder clamp assembly disposed at said first end of said support arm, said ladder clamp assembly including first and second clamp jaws, a first fastener and a first position adjuster, said first fastener engaged with said first position adjuster to allow releasable engagement of said first and second ladder clamp jaws with a vertical side support of the ladder;

a container clamp assembly disposed at said second end of said support arm, said container clamp assembly including a container clamp jaw, a second fastener and a second position adjuster disposed therebetween, said second fastener engaged with said second position adjuster to allow releasable engagement of said container clamp jaw over an annular lid flange of the container;

a first pivot disposed at said first end of said support arm to allow for pivoting of said support arm about said first central axis of rotation; and a second pivot disposed at said second end of said support arm for pivoting said container clamp assembly about said second central axis of rotation.

2. The self-leveling support device of claim 1 wherein said container clamp assembly further includes an elongated support member adapted to engage and provide support to an outer wall of the container.

3. The self-leveling supporting device of claim 2 wherein said elongated support member includes a series of vertically extending grooves to add structural strength and further includes an aperture to allow said second fastener to pass therethrough.

4. The self-leveling support device of claim 1 wherein said container clamp jaw is C-shaped.

5. The self-leveling supporting device of claim 1 wherein said support arm further includes a plurality of ribs to add structural strength.

6. The self-leveling supporting device of claim 1 wherein said support arm further includes a first aperture at the ladder securing end and a second aperture at the container securing end.

7. The self-leveling supporting device of claim 6 wherein said first aperture and said second aperture include cylindrical bearing inserts positioned inside said first aperture and said second aperture where said inserts have an axial length slightly longer than the axial length of said first aperture and said second aperture.

8. The self-leveling supporting device of claim 1 wherein said container clamp jaw further includes an aperture to allow said second fastener to pass therethrough.

9. The self-leveling supporting device of claim 1 wherein said first clamp jaw and said second clamp jaw further include outwardly extending flanges to create a channel shaped configuration for engaging the vertical side support of the ladder.

10. The self-leveling supporting device of claim 9 wherein said first clamp jaw and said second clamp jaw each include an aperture to allow said first fastener to pass through said apertures.

11. The self-leveling support device of claim 9 wherein said first clamp jaw further includes a groove defined in one face thereof for engagement with a channel edge of the vertical side support of the ladder.

12. The self-leveling support device of claim 9 wherein said first clamp jaw further includes an adjusting bolt for engagement with an inside surface of the vertical side support of the ladder.

* * * * *